US007278384B2

(12) United States Patent
Fernandez et al.

(10) Patent No.: US 7,278,384 B2
(45) Date of Patent: Oct. 9, 2007

(54) TIMING MECHANISM FOR A SWITCHABLE TWO-STEP ROLLER FINGER FOLLOWER

(75) Inventors: Hermes A. Fernandez, Pittsford, NY (US); Andrew J. Lipinski, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 64 days.

(21) Appl. No.: 11/240,710

(22) Filed: Sep. 30, 2005

(65) Prior Publication Data

US 2007/0074688 A1 Apr. 5, 2007

(51) Int. Cl.
*F01L 1/34* (2006.01)

(52) U.S. Cl. ..... 123/90.16; 123/90.15; 123/90.2; 123/90.39; 123/90.44; 74/568 R; 74/569

(58) Field of Classification Search ..... 123/90.16, 123/90.2

See application file for complete search history.

(56) References Cited

U.S. PATENT DOCUMENTS

| | | | | |
|---|---|---|---|---|
| 5,203,289 | A | 4/1993 | Hara | |
| 6,112,711 | A * | 9/2000 | Shimizu et al. | 123/90.16 |
| 6,463,897 | B2 * | 10/2002 | Fernandez et al. | 123/90.16 |
| 6,591,798 | B2 * | 7/2003 | Hendriksma et al. | 123/90.16 |
| 6,925,978 | B1 | 8/2005 | Gerseny | |
| 6,966,291 | B1 | 11/2005 | Fischer | |

FOREIGN PATENT DOCUMENTS

| | | | |
|---|---|---|---|
| DE | 196 52 180 | A1 | 6/1998 |
| DE | 196 52 675 | A1 | 6/1998 |
| DE | 198 01 604 | A1 | 7/1999 |
| EP | 1 277 924 | A2 | 1/2003 |
| EP | 1 568 859 | A | 8/2005 |

OTHER PUBLICATIONS

European Patent Office Search Report dated Dec. 2, 2007 with cited documents for European Application No. 06076683.9-2311.

* cited by examiner

*Primary Examiner*—Thomas Denion
*Assistant Examiner*—Kyle M. Riddle
(74) *Attorney, Agent, or Firm*—Paul L. Marshall

(57) ABSTRACT

A two-step roller finger follower having a movable high-lift portion and a low-lift portion. A lock pin mechanism in the low-lift portion includes a lock pin that may be driven hydraulically into latched engagement with the high-lift portion. The lock pin assembly comprises a lock pin and a separable switching pin. A blocking clip mountable on the associated hydraulic lash adjuster includes first and second ends that extend into a switching pin locking groove to block axial motion thereof. A ramp on the follower body mates with a ramp on the blocking clip such that oscillatory motion of the follower engages and disengages the blocking pin from the locking groove. The clip unblocks the switching pin at only those times in the camshaft rotational cycle when complete locking and unlocking is assured, and ending well before the beginning of the next valve lift event.

10 Claims, 5 Drawing Sheets

TIMING MECHANISM FOR A SWITCHABLE TWO-STEP ROLLER FINGER FOLLOWER

TECHNICAL FIELD

The present invention relates to roller finger followers for actuating the valves of internal combustion engines; more particularly, to two-step roller finger followers for controllably activating and deactivating engine valves between high-lift and low-lift modes; and most particularly, to a two-step roller finger follower having a timing mechanism governing locking and unlocking action of a lock pin to prevent partial pin engagement and consequent premature pin ejection during a high-lift valve event.

BACKGROUND OF THE INVENTION

Two-step roller finger followers (RFF) for controllably activating and deactivating compression valves in a variable valve activation train in an internal combustion engines are well known. An RFF extends between a hydraulic lash adjuster (HLA) and the stem of a valve. Engagement of the RFF with a cam lobe of an engine camshaft causes the RFF to be pivoted about the HLA and thereby to depress the valve stem, opening the valve.

A two-step RFF mechanism allows an engine valve to be operated by two different cam lobe profiles, one with first and second portions of the mechanism locked together by a slidable lock pin (typically for high lift) and the other with the mechanism portions unlocked (typically low lift).

In prior art RFFs, a known problem exists in that the lock pin may be only partially engaged with the high-lift follower portion of the RFF when a high-lift valve event begins. In some instances, there is enough engagement to begin to open the valve but not enough engagement to complete the full valve event. At some point during the valve event, the load on the lock pin becomes insupportable, ejecting the lock pin from engagement with the high-lift follower portion. The effect of this ejection event is that the valve spring compression energy is instantly released and transferred to either the lower-lift cam profile or to the valve seat.

Premature lock pin ejection is highly undesirable because a) the intended valve and engine event is frustrated, resulting in improper engine operation; b) the extreme shock produced in associated engine components may cause damage; and c) repeated ejections can damage the lock pin and the high-lift follower portion such that the RFF cannot function properly and must be replaced.

What is needed in the art is a two-step roller finger follower having a timing mechanism to ensure that a switching event can occur only immediately at the completion of a valve event, thereby maximizing the time available for the lock pin to completely translate, either into or out of locking relationship, and thus minimizing the opportunity for a lock pin ejection.

It is a principal object of the present invention to prevent lock pin ejections during operation of a two-step switchable roller finger follower in an internal combustion engine.

SUMMARY OF THE INVENTION

Briefly described, a two-step roller finger follower in accordance with the invention includes a high-lift follower portion that moves relative to a low-lift follower portion about a pivot shaft. The low-lift portion is engaged by and follows one or a pair of low-lift cam lobes, and the high-lift follower portion follows one or a pair of high-lift cam lobes.

A variable lock pin mechanism is disposed in the low-lift portion and includes an actuable lock pin that may be driven hydraulically slidably into latched engagement with a nose on the high-lift portion. When the low-lift and high-lift portions are latched together, only the high-lift portion engages the camshaft lobe, thus activating the corresponding engine valve in high-lift mode. When the low-lift and high-lift portions are unlatched, both the high-lift portion and the low-lift portion engage their respective camshaft lobes, but the high-lift portion moves in lost motion and thus the corresponding engine valve is activated in low-lift mode only by the low-lift cam lobe.

The lock pin assembly is slidably disposed in a bore. The lock pin assembly comprises a lock pin and a separable switching pin for driving the lock pin into engagement. A resilient blocking clip includes first and second ends that extend into a locking groove in the lock pin assembly to block axial motion of the switching pin in either the pin engagement or pin disengagement direction during times when movement of the locking pin could cause pin ejection. A first ramp on the low-lift RFF portion mates with a second ramp on the blocking clip such that oscillatory motion of the RFF alternately engages and disengages the blocking pin from the locking groove. Correct predetermined rotational positioning of the first and second ramp elements serves to restrict unblocking of the switching pin, and consequent actuation of the lock pin, to only those times in the camshaft rotational cycle when complete engagement and disengagement is assured. Preferably, unblocking of the switching pin occurs at the beginning of a valve lift event to permit pre-loading of the switching and lock pins and ending well before the beginning of the next valve lift event.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
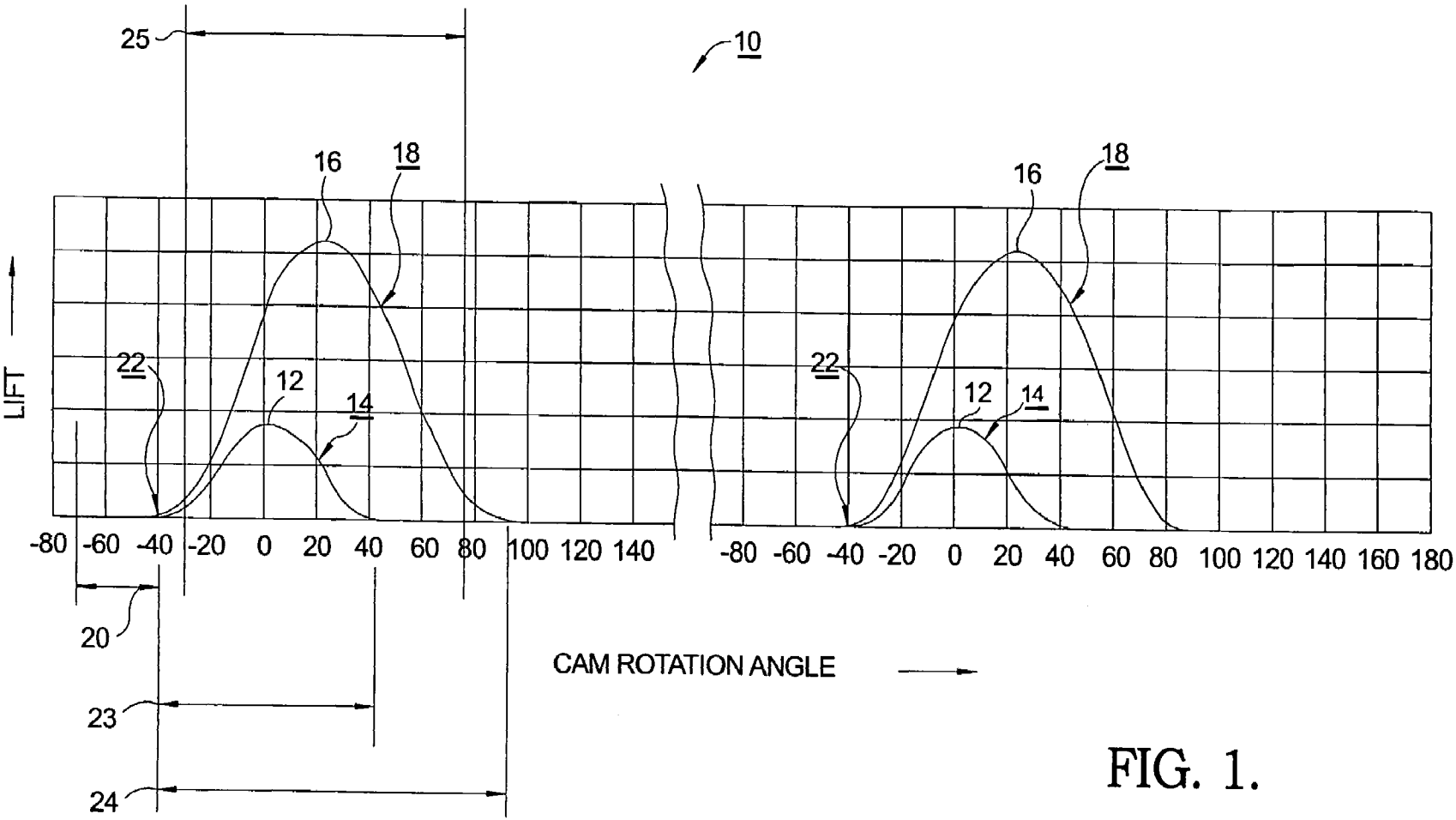
FIG. 1 is a graph showing valve lift profiles as a function of cam rotation angle and RFF lock engagement/disengagement sectors for the prior art and also in accordance with the present invention.
Figure 2:
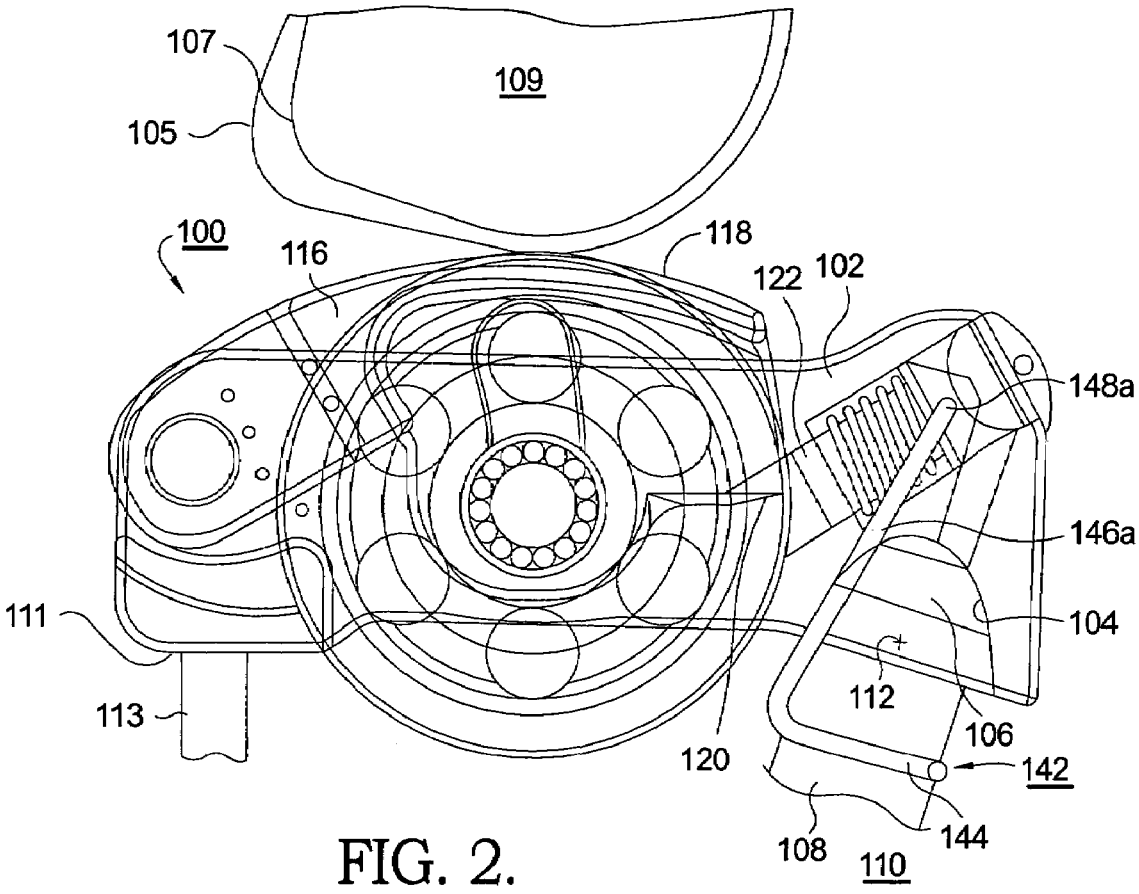
FIG. 2 is an elevational transparent view of a two-step RFF, in engagement with a section of the camshaft, in accordance with the invention.

Referring to FIG. 1, a graph 10 shows exemplary valve lift profiles as a function of cam rotation angle in an internal combustion engine for two revolutions of the cam. The peak lift 12 for a low-lift valve event 14 is arbitrarily defined herein as 0° cam rotation angle. In the present example, the peak lift 16 for a high-lift valve event 18 is about 21° after low-lift peak 12. The duration of low lift event 14, shown as segment 23 in FIG. 1, is from before about −30 degrees to after about +30 degrees. The duration of high-lift event 18, shown as segment 24 in FIG. 1, is from before about −30 degrees to after about +88 degrees. A two-step roller finger follower is capable of selectively providing either low-lift event 14 or high-lift event 18 in response to a hydraulic signal provided via an electronic engine control module, as is well known in the prior art.

As described above, a problem in prior art RFFs is that the cam rotation angle at which the RFF is commanded to lock the RFF in high-lift mode is substantially uncontrolled and may be subject to any of several operational variables. That is, the RFF can be commanded to lock during a valve lift event or at anytime when the valve is closed. Obviously, actual engagement and disengagement may occur only when the contact surface of the RFF high-lift follower portion is in contact with the base circle portion of its respective cam lobe (between successive valve events). When, for example, the command is given at about 80 degrees cam rotation, the lock pin will have ample time to fully engage the nose of the high-lift follower portion before the onset 22 of a commanded high-lift event 18. However, if the command is given during, for example, a rotational segment 20 just before the onset 22 of a commanded high-lift event 18, wherein the high-lift element is forced by the cam eccentric to move, the lock pin may not have time to fully engage the nose on the RFF high-lift follower portion and may result in the lock pin being violently ejected from such partial engagement during the high-lift event, thus aborting the event and risking damage to the RFF.

Referring now to FIGS. 2 through 5, a two-step roller finger follower 100 in accordance with the invention generally comprises prior art high- and low-lift components as follows. A follower body 102 includes a domed seat 104 for receiving the domed head 106 of a hydraulic lash adjuster (HLA) 108 mounted on an engine 110. In operation, follower 100 pivots vertically on head 106 about a horizontal axis 112 in response to the action of high- lift 105 and low-lift 107 cam lobes of camshaft 109. Follower 100 has an end 111, opposite domed seat 104 to actuate valve 113 in either high-lift or low-lift mode. The pivoting action of follower 100 is an essential element of the present invention as described further below. (It should be understood that "vertical" and "horizontal" as used herein refer to FIG. 2 as an elevational view.) Lifter body 102 includes a central aperture 114 for slidably receiving a high-lift follower portion 116 having a contact surface 118, such as for example, a slider surface or a roller, for engaging high-lift cam lobe 105 and a slider nose 120 for engaging a lock pin 122 of a lock pin assembly 124 that is actuated in accordance with the invention and as will now be described.

Lock pin assembly 124 is slidably disposed in a bore 126 in follower body 102 oriented such that lock pin 122 may selectively engage slider nose 120. It is an important feature of the present invention that such engagement is permitted, as described below, only immediately after completion of high-lift event 18 (segment 24 in FIG. 1) when lock pin 122 will have ample time to fully engage slider nose 120 and partial pin engagement and subsequent premature ejection cannot occur.

Figure 3:
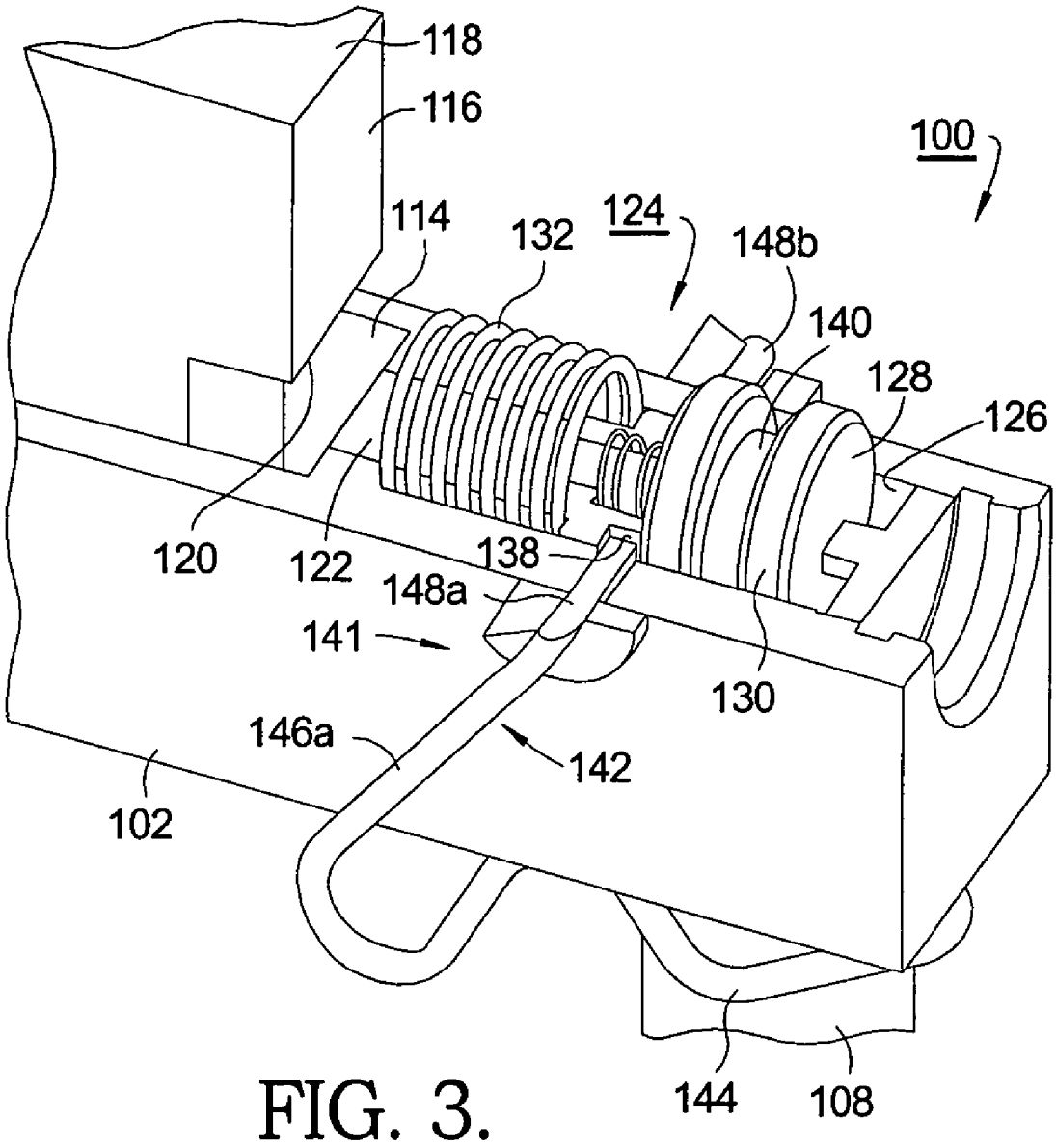
FIG. 3 is an isometric view, partially in cutaway, of the RFF shown in FIG. 2.
Figure 4:
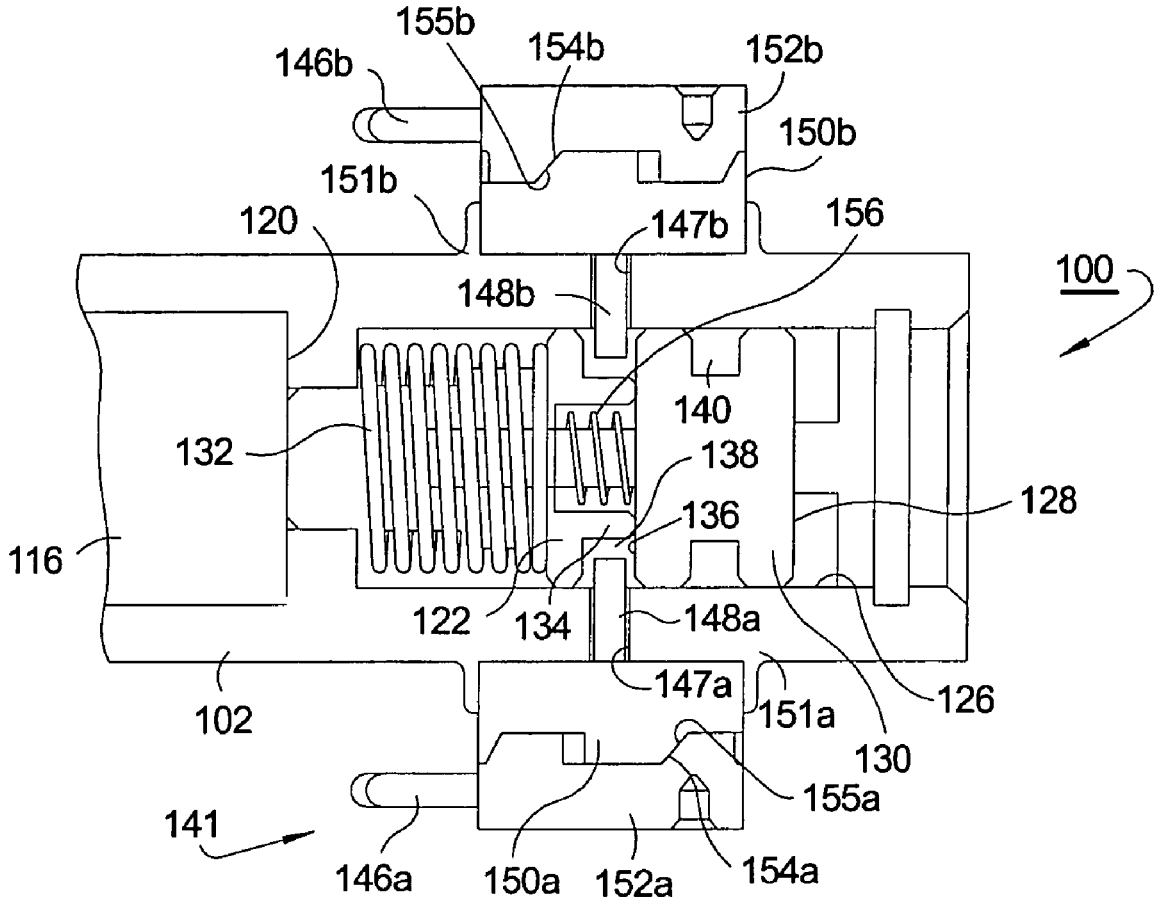
FIG. 4 is a plan view of the RFF as shown in FIG. 3, showing the lock pin assembly blocked in the unlatched position.

Lock pin assembly 124 is shown in FIGS. 3 and 4 in an unlatched position wherein lock pin 122 is fully retracted from engagement with slider nose 120 (note that in the cutaway view shown in FIG. 3, the upper portion of lock pin 122 is cutaway and hence cannot be seen). Assembly 124 is switched into the latched position (FIG. 5) by the controlled provision of pressurized engine oil, as for example, from HLA 108 against first face 128 of switching pin 130, causing switching pin 130 to translate which in turn causes lock pin 122 to translate, thus urging lock pin 122 into engagement with nose 120. Return spring 132 is compressed by such translation and serves to disengage lock pin 122 from nose 120 after hydraulic pressure is removed from face 128.

Figure 5:
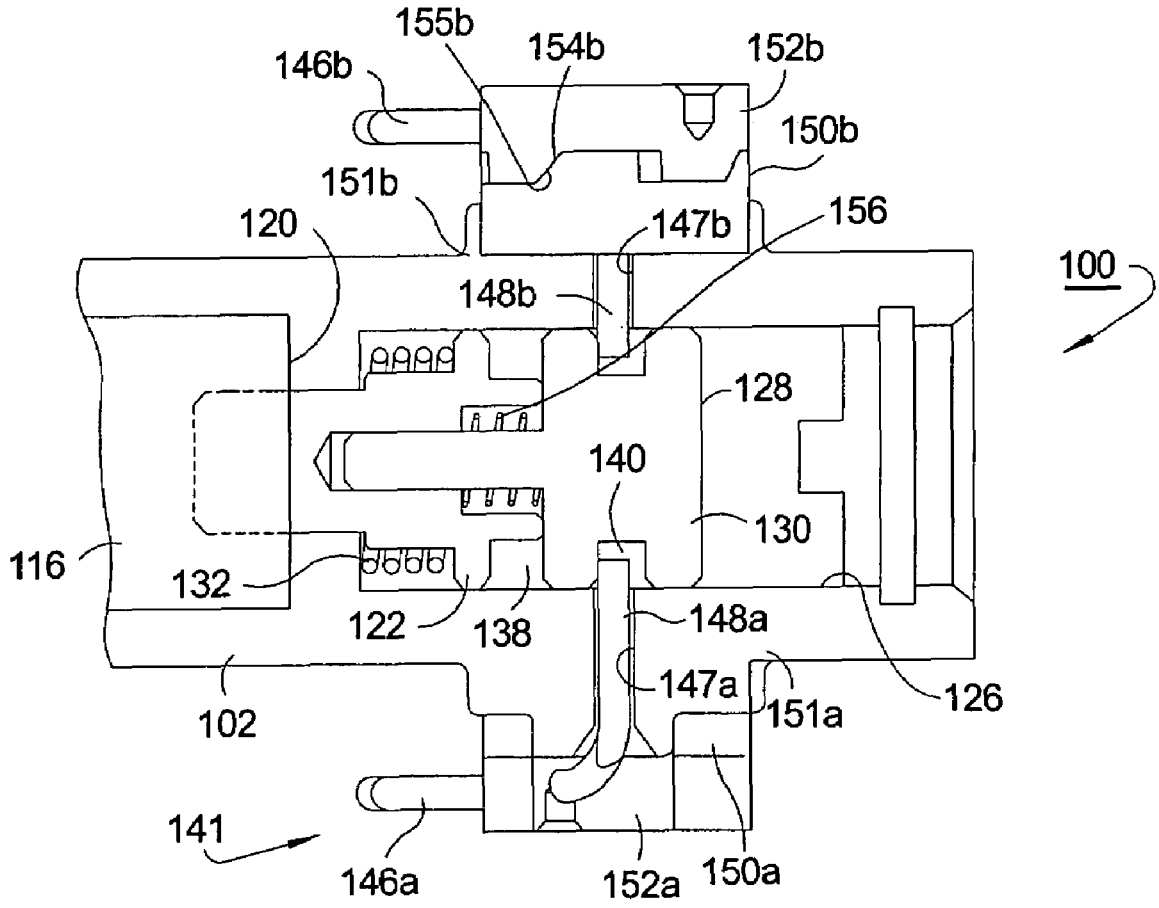
FIG. 5 is a plan view of the RFF as shown in FIG. 3, showing the lock pin assembly blocked in the latched position.

As best seen in FIGS. 3-5, switching pin 130 is disposed co-axially with lock pin 122. A necked portion 134 of lock pin 122 engages a second face 136 of switching pin 130 opposite first face 128, creating thereby a first annular groove 138. A second annular groove 140 is provided in the outer surface of switching pin 130.

A blocking assembly 141 includes blocking clip 142 formed from spring wire. Clip 142 comprises a centrally-located partial loop 144 that grips HLA 108 firmly when installed thereupon (FIGS. 2 and 3), and further includes first and second spring portions 146*a*, 146*b* that extend alongside RFF body 102. Portions 146*a*, 146*b* terminate in first and second blocking end portions 148*a*, 148*b* that enter body 102 through respective clip bores 147*a*, 147*b* generally transverse of bore 126 and, in relaxed mode, extend into bore 126. In relaxed mode, as described below, end portions 148*a*, 148*b* may extend into either first annular groove 138 (FIGS. 3 and 4) or second annular groove 140 (FIG. 5), depending upon the currently commanded position of the locking assembly.

Blocking assembly 141 also includes first and second inner bosses or "pucks" 150*a*, 150*b* rigidly attached to opposing walls 151*a*, 151*b* of RFF body 102 so that pucks 150*a*, 150*b* rotate with the pivoting of follower 100 about axis 112. Pucks 150*a*, 150*b* have openings aligned with clip bores 147*a*, 147*b* through which end portions 148*a*, 148*b* enter transverse bore 126. First and second outer pucks 152*a*, 152*b* are disposed outboard of respective inner pucks 150*a*, 150*b* and are fixedly mounted onto spring portions 146*a*, 146*b*, as shown in FIGS. 4 and 5 so that pucks 152*a*, 152*b* do not rotate with pucks 150*a*, 150*b* when follower 100 pivots about axis 112. Slidable, wedged interfaces or ramps 154*a*, 154*b* and 155*a*, 155*b* are provided on the inner and outer pucks 150,152, respectively, such that the pucks function in relative rotation similarly to tapered washers.

Pivoting of body 102 on HLA 108 about axis 112 during either a low-lift valve event 14 (segment 23 in FIG. 1) or a high-lift valve event 18 (segment 24 in FIG. 1) causes relative rotation between the inner and outer pucks. Because of wedged interfaces 154, 155, outer pucks 152*a*, 152*b* are translated outwards of inner pucks 150*a*, 150*b*, thus withdrawing blocking end portions 148*a*, 148*b* from bore 126 during valve events 14,18. During valve events, because the nose of high-lift portion 116 has rotated below lock pin 122 (low-lift mode) or because of the side load exerted on lock pin 122 by nose 120 (high-lift mode), lock pin 122 cannot engage or disengage but can be pre-loaded for such action such that the action occurs immediately at the end of the valve event. Thus, by restricting withdrawal of end portions 148*a*, 148*b* to a range 25, from about −30 degrees to about +75 degrees, slightly within the duration of high-lift event 18 (segment 24), engagement and disengagement of lock pin 122 with nose 120 are restricted only to the immediate end of the valve event when the valve closes and the lifter nose 120 is unloaded (engaged to disengaged switch) or the lifter nose 120 is above locking pin 122 (disengaged to engaged switch) . Because end portions 148*a*, 148*b* are reinserted into either of grooves 138,140 well before the beginning of the next valve event, movement of the lock pin is prevented when lock pin 122 does not have ample time to fully engage nose 120, such as for example during region 20, thus preventing partial engagement of the lock pin to the nose and consequent ejection of the lock pin as load is increased during a valve event.

It is an important aspect of the present invention that no special external timing apparatus or software is required. The blocking clip ends are withdrawn and reinserted simply by the oscillatory action of the RFF body, which is mechanically timed by the action of the associated cam lobes. Thus the translatory motion of the clip ends is inherently governed by the position of the cam and the RFF body.

The mechanism also times the switch of the lock pin from engaged to disengaged position. When oil pressure is removed from switching pin first face 128, and if the blocking end portions 148*a*, 148*b* are retracted from annual groove 140 (such as during range 25), compressed second return spring 156 urges switching pin 130 away from lock pin 122 to the switching pin's unlatched position (FIGS. 3 and 4). However, lock pin 122 remains engaged with nose 120 in high-lift mode because of the load imposed on the lock pin through high-lift follower portion 116 by the compressed valve spring (not shown) associated with engine valve 113. As soon as the high-lift valve event is complete (end of segment 24), the load exerted by engine valve 113 is removed from lock pin 122, and return spring 132 translates lock pin 122 out of engagement with nose 120 (FIG. 5) and into renewed contact with switching pin 130 in the unlatched position (FIGS. 3 and 4). Because of the angular orientations of pucks 150,152 and wedged interfaces 154, the delatching motion of the lock pin is timed to begin at the immediate start of the cam base circle (end of valve event), thus maximizing the time available to complete the translation and minimizing the possibility of locking pin ejection.

It should be understood, of course, that the RFF components and cam lobes referred to hereinabove as "low-lift" and "high-lift" may be exchanged by appropriate configuration of the RFF and cam lobes such that the unlatched mode is a high-lift mode and the latched mode is a low-lift mode; and both configurations are fully embraced within the scope of the present invention.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A two-step roller finger follower for use with a camshaft in a variable valve actuation train of an internal combustion engine, comprising:

a) a low-lift cam follower having a central aperture, a first end for engaging a pivot point, and a second end for engaging a valve stem of said engine;

b) a high-lift cam follower disposed in said central aperture;

c) a locking assembly disposed in a bore in said low-lift cam follower for selectively engaging and disengaging said low-lift follower to and from said high-lift cam follower, said locking assembly comprises:

a lock pin for providing said engagement and disengagement; and a switching pin disposed coaxially with said lock pin for urging said lock pin into said engagement;

d) a blocking assembly for preventing said engagement and disengagement from occurring during a first predetermined portion of a rotational cycle of said camshaft.

2. A roller finger follower in accordance with claim 1 wherein said blocking assembly includes a blocking clip.

3. A roller finger follower in accordance with claim 1 wherein said locking assembly comprises a first return spring disposed between said locking assembly and said low-lift cam follower for urging said lock pin into said disengagement.

4. A roller finger follower in accordance with claim 2 wherein said blocking clip includes a central loop portion for anchoring said blocking clip to said engine.

5. A roller finger follower in accordance with claim 4 wherein said central loop portion is anchorable to a hydraulic lash adjuster supportive of said roller finger follower for anchoring said blocking clip to said engine.

6. A two-step roller finger follower for use with a camshaft in a variable valve actuation train of an internal combustion engine, comprising:

a) a low-lift cam follower having a central aperture, a first end for engaging a pivot point, and a second end for engaging a valve stem of said engine;

b) a high-lift cam follower disposed in said central aperture;

c) a locking assembly disposed in a bore in said low-lift cam follower for selectively engaging and disengaging said low-lift follower to and from said high-lift cam follower, said locking assembly comprising:

a lock pin for providing said engagement and disengagement;

a switching pin disposed adjacent said lock pin for urging said lock pin into said engagement; and a first return spring disposed between said locking assembly and said low-lift cam follower for urging said lock pin into said disengagement;

d) a blocking assembly for preventing said engagement and disengagement from occurring during a first predetermined portion of a rotational cycle of said camshaft; and e) a second return spring disposed between said lock pin and said switching pin for moving said switching pin away from said lock pin.

7. A two-step roller finger follower for use with a camshaft in a variable valve actuation train of an internal combustion engine, comprising:

a) a low-lift cam follower having a central aperture, a first end for engaging a pivot point, and a second end for engaging a valve stem of said engine;

b) a high-lift cam follower disposed in said central aperture;

c) a locking assembly disposed in a bore in said low-lift cam follower for selectively engaging and disengaging said low-lift follower to and from said high-lift cam follower; and d) a blocking assembly for preventing said engagement and disengagement from occurring during a first predetermined portion of a rotational cycle of said camshaft, said blocking assembly comprises:

a blocking clip;

a first ramp surface in communication with said low-lift cam follower;

a second ramp surface in communication with said blocking clip and in engagement with said first ramp surface;

wherein said blocking clip includes an end for selectively engaging said locking assembly.

8. A roller finger follower in accordance with claim 7 wherein relative movement between said first and second ramp surfaces causes said clip end to selectively engage said locking assembly.

9. A roller finger follower in accordance with claim 8 wherein said relative movement between said first and second ramp surfaces results from rotation of said camshaft against said two-step roller finger follower.

10. An internal combustion engine having a system for deactivation of engine valves, the engine comprising a rotatable camshaft and at least one two-step roller finger follower in engagement with said camshaft, said two-step follower having, a low-lift cam follower having a central aperture, a first end for engaging a pivot point, and a second end for engaging a valve stem of at least one of said engine valves, a high-lift cam follower disposed in said central aperture, a locking assembly disposed in a bore in said low-lift cam follower for selectively engaging and disengaging said low-lift follower to and from said high-lift cam follower;

a blocking assembly, including a blocking clip and at least one ramp surface in communication with said low-lift cam follower and at least one opposing ramp surface in communication with said blocking clip for preventing said engagement and disengagement from occurring during a first predetermined portion of a rotational cycle of said camshaft; and for allowing said engagement and disengagement to occur during a second predetermined portion of a rotational cycle of said camshaft.

* * * * *